US009656678B2

(12) United States Patent
Morel

(10) Patent No.: US 9,656,678 B2
(45) Date of Patent: May 23, 2017

(54) ASSEMBLY FOR LOADING AND UNLOADING SEMI-TRAILERS ON RAILWAY WAGONS

(71) Applicant: LOHR INDUSTRIE, Hangenbieten (FR)

(72) Inventor: Hervé Morel, Ostwald (FR)

(73) Assignee: Lohr Industrie, Hangenbieten (FR)

( * ) Notice: Subject to any disclaimer, the term of this patent is extended or adjusted under 35 U.S.C. 154(b) by 86 days.

(21) Appl. No.: 14/369,620

(22) PCT Filed: Jan. 23, 2013

(86) PCT No.: PCT/IB2013/050581
§ 371 (c)(1),
(2) Date: Jun. 27, 2014

(87) PCT Pub. No.: WO2013/111068
PCT Pub. Date: Aug. 1, 2013

(65) Prior Publication Data

US 2014/0363261 A1 Dec. 11, 2014

(30) Foreign Application Priority Data

Jan. 27, 2012 (FR) ..... 12 50782

(51) Int. Cl.
*B65G 67/02* (2006.01)
*B61D 3/18* (2006.01)

(52) U.S. Cl.
CPC ..... *B61D 3/184* (2013.01); *B61D 3/18* (2013.01)

(58) Field of Classification Search
CPC ..... B61D 3/18; B61D 3/184
See application file for complete search history.

(56) References Cited

U.S. PATENT DOCUMENTS

| | | | | |
|---|---|---|---|---|
| 2,903,978 | A | 9/1959 | Gaynor | |
| 3,516,368 | A * | 6/1970 | Wright | B61D 3/04 105/455 |
| 3,528,569 | A * | 9/1970 | Barry | B60P 7/13 294/68.3 |
| 3,784,028 | A | 1/1974 | Stewart | |
| 5,105,951 | A * | 4/1992 | Gearin | B60P 3/07 211/191 |
| 5,857,821 | A | 1/1999 | Wiedeck | |

(Continued)

FOREIGN PATENT DOCUMENTS

| | | | |
|---|---|---|---|
| FR | 2 913 938 | A1 | 9/2008 |
| WO | 97/09260 | A1 | 3/1997 |

*Primary Examiner* — Patrick Maestri
(74) *Attorney, Agent, or Firm* — Seed IP Law Group LLP

(57) ABSTRACT

The invention relates to an assembly for loading and unloading a semi-trailer on a railway wagon, comprising a loading and unloading structure intended to receive the semi-trailer. The loading and unloading structure comprises a lower portion in the form of a support plate intended to carry the semi-trailer and an upper portion in the form of a handling frame intended to be handled and moved by a standard means for handling containers. To this end, the upper portion of the handling frame has a standard container interface intended to be handled and moved by a standard means for handling containers. The support plate and the handling frame are connected either by a fixed link or by a detachable link.

20 Claims, 5 Drawing Sheets

(56) References Cited

U.S. PATENT DOCUMENTS

| | | | | |
|---|---|---|---|---|
| 6,205,932 | B1 * | 3/2001 | Khattab | B61D 3/18 105/355 |
| 2008/0271634 | A1 * | 11/2008 | Eriksson | B61D 47/005 105/355 |

* cited by examiner

ASSEMBLY FOR LOADING AND UNLOADING SEMI-TRAILERS ON RAILWAY WAGONS

BACKGROUND

Technical Field

This invention refers to an assembly for the loading and unloading of semi-trailers on railway wagons comprising a loading and unloading structure for semi-trailers consisting of a standard container interface at the top in order to be able to use container handling means which exist, for instance, in combined transport terminals.

Description of the Related Art

There is a well-known means of container transport for their transportation on the beds of semi-trailers or the beds of freight wagons. Since the characteristics of the transport containers are standardized, in particular their sizes, there are means of handling containers allowing containers to be handled and moved, in particular for being picked up from the top from a semi-trailer bed and their placing on the bed of a freight wagon or vice versa.

Because the structural strength of the semi-trailers is low, there was no way of directly handling all the semi-trailers in the same way as the container. This would be an advantage in facilitating rail-road transport, that is the railway transport of semi-trailers on railway wagons, generally requiring specific wagons and related structures which are costly and dedicated solely to this purpose. The possibility of directly handling and an entire semi-trailer by existing container handling means would dispense with many structures and modifications which are required for road-rail transport, resulting in an obvious saving in cost and space in terms of railway installations and loading and unloading times.

BRIEF SUMMARY

The purpose of the invention is to supply a loading and unloading structure which would resolve the aforementioned technical issue.

The solution of the invention is to use a loading and unloading structure in which a semi-trailer is easily and quickly loaded by a tractor vehicle. This loading and unloading structure includes a lower section in the form of a support plate designed to carry the semi-trailer and an upper part in the form of a handling frame with, at the top, a standard container interface for the handling and movement of the handling frame by existing container handing means. The support plate and of the handling frame can be connected together either by a fixed link or by a separable link. In the second case, the handling frame with the existing container handling means can be removed to facilitate loading and unloading operations of the semi-trailer on the support plate.

BRIEF DESCRIPTION OF THE SEVERAL VIEWS OF THE DRAWINGS

Other characteristics and advantages of the invention will appear from the reading of the detailed description which follows, referring to the attached illustrations in which.

DETAILED DESCRIPTION

Figure 1:
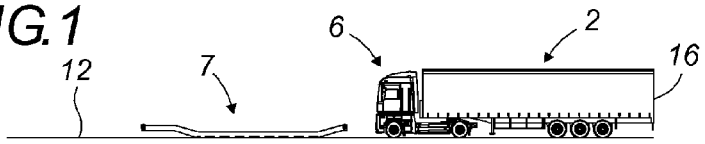
FIGS. 1 to 9 are profile views illustrating the loading of a semi-trailer onto a transport wagon by means of the loading and unloading structure of the invention in which the support plate and the handling frame are connected by a separable link.

The loading and unloading structure 1 for semi-trailers 2 according to this invention will now be described in detail with reference to the attached figures.

The loading and unloading structure 1 for semi-trailers 2 according to this invention includes a standard handling means 3 for containers 4 and a loading and unloading structure 5 in which a semi-trailer 2 is loaded by a tractor vehicle 6. This loading and unloading structure 5 includes a lower part in the form of a support plate 7 designed to carry the semi-trailer 2 and an upper part in the form of a handling frame 8. This handling frame also provides protection of the sides or full protection of the load during railway transport from external aggressions, wind, projection of ballast, vandalism, etc.

The term standard handling means 3 for containers 4 refers to a handling means 3 for containers 4 like those which exist for the handling of standard containers 4, unlike a handling means which would be adapted exclusively to a specific type of nonstandard container.

The handling frame 8 comprises a standard container interface 9 arranged in the upper part so that it can be handled and moved by current handling means 3 for containers 4. The term standard container interface 9 refers to the fact that the handling frame 8 has, at the top, the same attaching arrangements 10 as standardized containers, for instance corner gussets 20 with holes to accommodate rotating locks 21 of the gripping tool of the handling means 3 for containers 4. These corner gussets 20 are arranged in a standard manner with respect to one another, in the same way as for a container 4. This allows handling frame 8 to be handled by conventional handling structures 3 designed for standard containers 4. In its lower section, for instance on the underside, support plate 7 contains, for instance, standard container interfaces. The standard interface of the container refers to attaching devices 10 in the form of corner gussets 20 with holes to accommodate the rotating locks 21 of the platforms 19 on the rail transport wagons 11. These corner gussets 20 are arranged, for instance, in a standard manner with respect to one another, in the same way as for a container 4.

The support plate 7 and of the handling frame 8 can be connected together either by a fixed link or by a separable link. The structure can also be the same machined and welded structure.

The alternative with a separable link offers the advantage of fully liberating the support plate 7 to facilitate road convoy maneuvers. Another advantage is that of proposing a handling frame 8 which is closed at the ends to protect the semi-trailer 2 entirely during its transport by rail.

In all cases, the support plate 7 or the handling frame 8 can be prearranged to accommodate a means of locking the pivot of the semi-trailer 2. This means of locking can be used for immobilizing the semi-trailer 2 with respect to the support plate 7 during its transport by rail. This means of locking can be installed with a handling machine. It is locked onto the frame of the handing frame 8 and locks the attaching swivel of the semi-trailer 2. This means of locking can correspond to that described in the request for patent FR2 913 938 in the name of the same applicant.

It is advantageous if this means of locking in the swivel of the semi-trailer 2 is part of the wagon in the same way as any gondola wagon intended for the transport of a semi-trailer 2, suitable for picking up by a grab.

This alternate version does not require the use of additional handling machines. It is during the loading of the semi-trailer system 2 in its handling frame 8 on the railway wagon 11 that the centering and locking of the swivel of semi-trailer 2 takes place.

Depending on the chosen alternative, the operation of the loading and unloading structure 2 for semi-trailers 2 according to this invention is not the same.

FIGS. 1 to 19 represent the loading of a semi-trailer 2 onto a railway wagon 11 using a loading and unloading structure 5 according to the invention in which the support plate 7 and the handing frame 8 are connected by a separable link.

Figure 2:
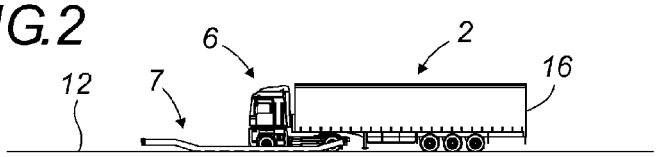
Figure 3:
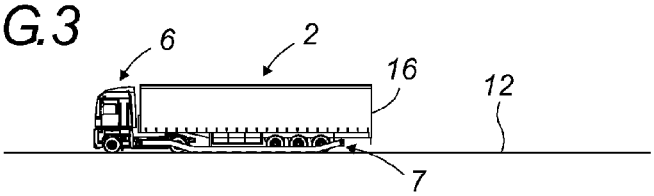
Figure 4:
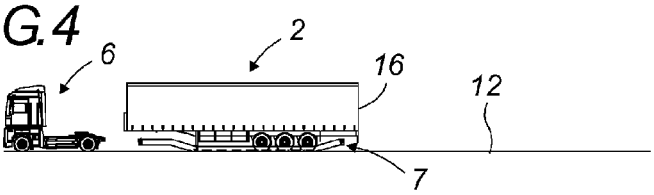

According to this first alternative, support plate 7 is first placed on the ground 12 (FIG. 1), then the semi-trailer 2 is loaded onto support plate 7 by a tractor vehicle 6 (FIG. 2). The tractor vehicle 6 can be the normal attractive vehicle of the semi-trailer 2 or any other vehicle suitable for towing a semi-trailer 2. Once the semi-trailer 2 has been loaded on to the support plate (FIG. 3), it is uncoupled from the tractor vehicle 6 (FIG. 4) which can then move off. It then stands on its struts.

Figure 5:
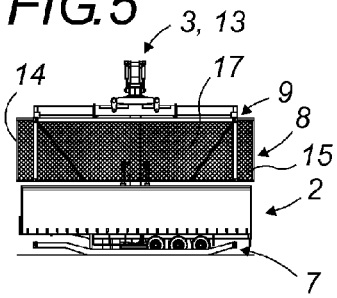
Figure 10:
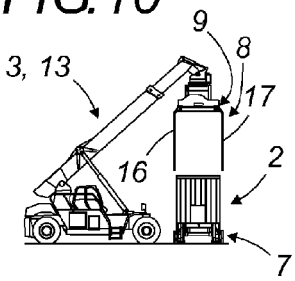
FIGS. 10 to 14 are head-on views corresponding to FIGS. 5 to 9 in which the front and/or rear ends of the handling frame are open.
Figure 15:
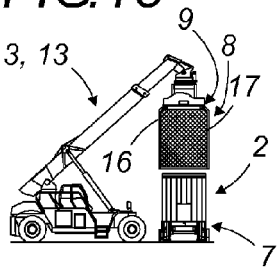
FIGS. 15 to 19 are head-on views corresponding to FIGS. 5 to 9 in which the front and/or rear ends of the handling frame are closed or can be closed off.

After this first step, the handling frame 8 is picked up by a handling structure 3 for containers 4 using the standard container interface 9 then lifted and moved above the semi-trailer 2 loaded onto support plate 7 (FIGS. 5, 10, 15).

The handling structure 3 for containers 4 can be a standard handling means 3 for containers 4 as are customarily used in combined transport terminals. In the figures, it is shown as a container carrier 13, but it could also be a crane, a gantry, a lifting beam or any other handling structure 3 for containers 4.

Figure 6:
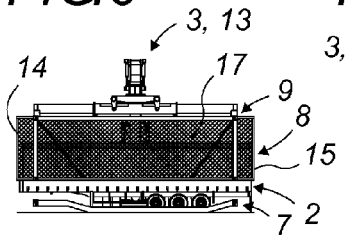
Figure 11:
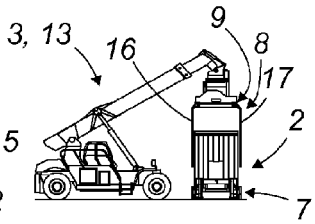
Figure 16:
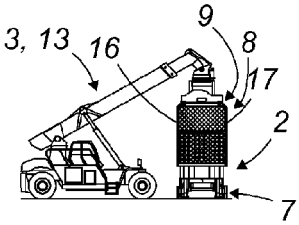
Figure 7:
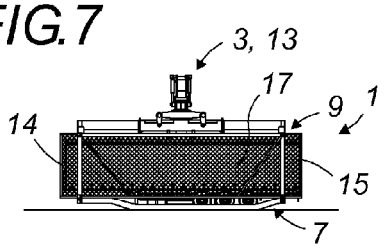
Figure 12:
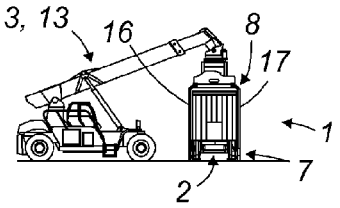
Figure 8:
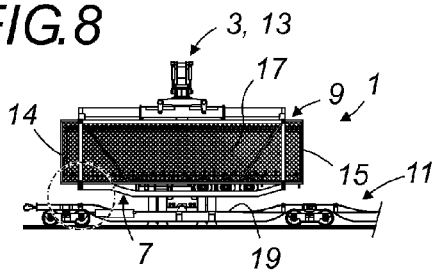
Figure 13:
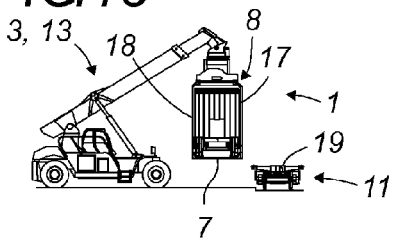
Figure 36:
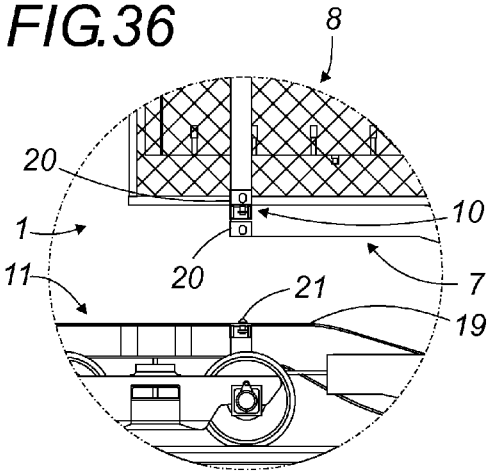
FIGS. 36 and 39 are detail views of the circled parts respectively of FIGS. 8, 9, 25 and 26.

Once the handling frame 8 has been placed above the semitrailer 2 loaded onto the support plate 7, it is lowered so that it envelopes at the least partially the semi-trailer 2 (FIGS. 6, 11, 16). The support plate 7 and the handling frame 8 are then connected and locked (FIGS. 7, 12, 17), for instance by means of the same rotating lock attaching devices 10 as those used for locking the containers (see FIG. 36).

Although the system is larger than a conventional standard container 4, the assembly formed by the handling frame 8, semi-trailer 2 and support plate 7 can be handled like a standard container because on the upper and lower faces it has the same attaching devices 10 in the same places as a standard container 4, preferably a large model.

Figure 9:
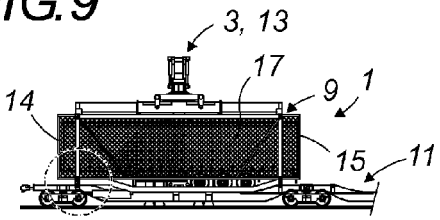
Figure 14:
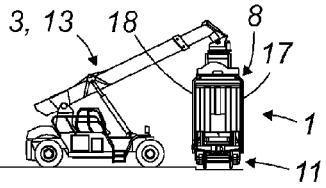
Figure 17:
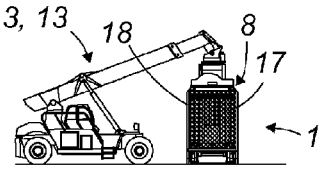
Figure 19:
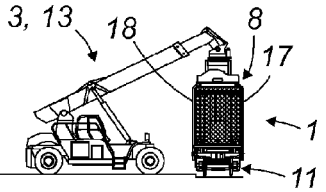
Figure 18:
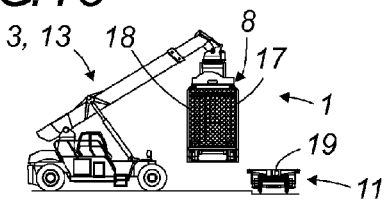
Figure 20:
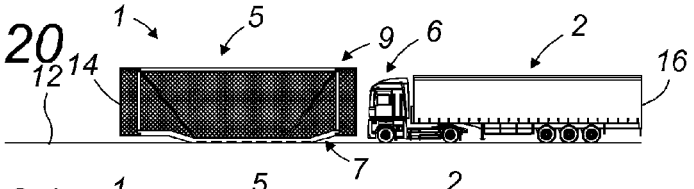
FIGS. 20 to 26 are profile views illustrating the loading of a semi-trailer onto a transport wagon by means of the loading and unloading structure of the invention in which the support plate and the handing frame are connected by a fixed link.

Once the support plate 7 and the handling frame 8 have been connected and locked together, they are lifted with the semi-trailer 2 by the handling means 3 for containers 4 (FIGS. 8, 13, 18), and moved by it so that they can be set down on the support plate 7 of a railway transport wagon 11 (FIGS. 9, 14, 19). This railway transport wagon 11 is preferably designed for the transport of containers 5 and accordingly is provided with rotating block attaching devices 10 on the upper side, working together with those located at the bottom of support plate 7. Preferably, this railway transport wagon 11 is of the extra-low swan-neck platform type 19 or is open at the center, like a gondola. This configuration can accommodate the lowered support plate 7 while employing the standard interfaces of the container. This decreases the loading height.

Figure 37:
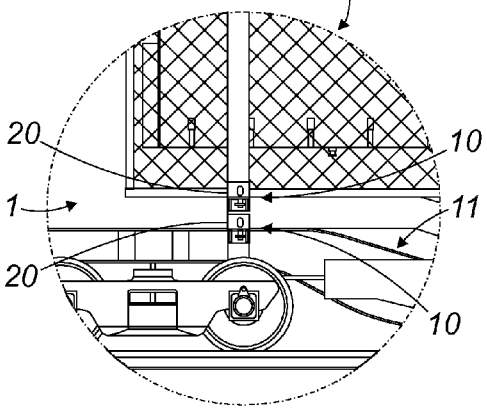

Following this second step, when the assembly formed by the handling frame 8, the semi-trailer 2 and the support plate 7 is put down by the handling means 3 for containers 4 on the support plate 7 of the railway transport wagon 11, the rotating lock attaching devices tend of the railway transport wagon 11 are locked with those at the bottom of the support plate 7 (see FIG. 37) and the handling means 3 for containers can be moved away. The system is then ready for transport by rail.

FIGS. 20 to 29 represent the loading of a semi-trailer 2 onto a railway wagon 11 using a loading and unloading structure 5 according to the invention in which the support plate 7 and the handing frame 8 are connected by a fixed link. A fixed connection means that the support plate 7 and the handling frame 8 are inseparable. This loading system, more or less similar to that of the first alternative regarding some of these stages, is described below.

This variant offers the advantage of being of a simpler design and construction than the separable variant.

Figure 21:
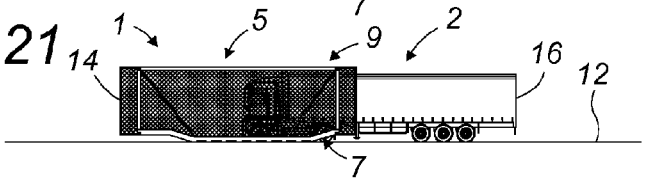
Figure 22:
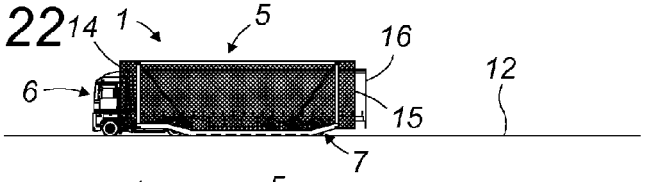
Figure 23:
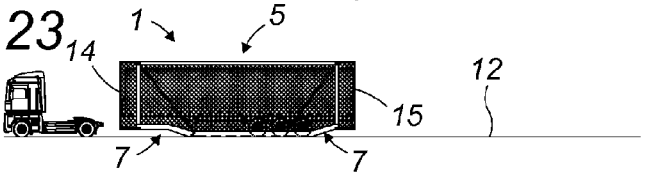

According to this second alternative, the loading and unloading the structure 5 formed by the handling frame 8 and the support plate 7 is first placed on the ground 12 (FIG. 20), then the semi-trailer 2 is loaded onto support plate 7 inside the handling frame 8 by a tractor vehicle 6 (FIG. 21). Once the semi-trailer 2 has been loaded into the loading and unloading structure 5 (FIG. 22), it is uncoupled from the tractor vehicle 6 (FIG. 23) which can then move off.

Figure 24:
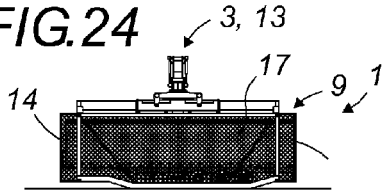
Figure 27:
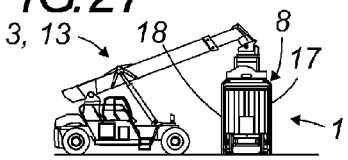
FIGS. 27 to 29 are head-on views corresponding to FIGS. 24 to 26 in which the front and/or rear ends of the handling frame are open.
Figure 25:
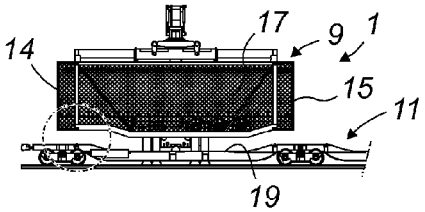
Figure 28:
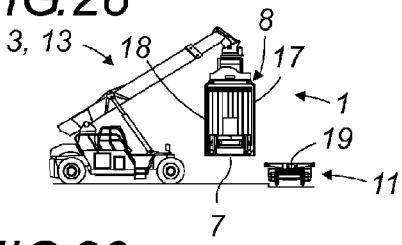
Figure 26:
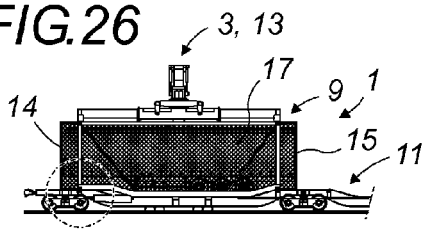
Figure 29:
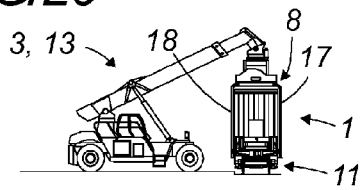
Figure 30:
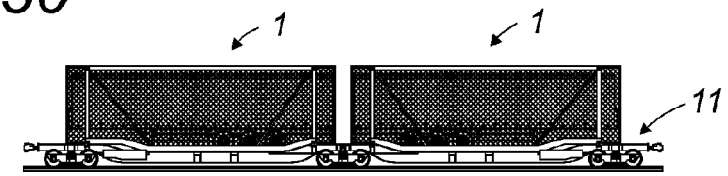
FIG. 30 is a profile or view of a succession of extra-low transport wagons 3 on which the semi-trailers are loaded by means of the loading and unloading structure of the invention in which the support plate is in the form of a gondola.
Figure 31:
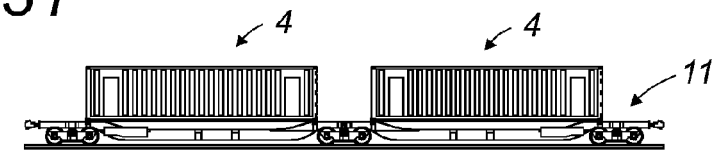
FIGS. 31 and 32 are profile views of a succession of extra-low transport wagons on which the transport containers are loaded.
Figure 32:
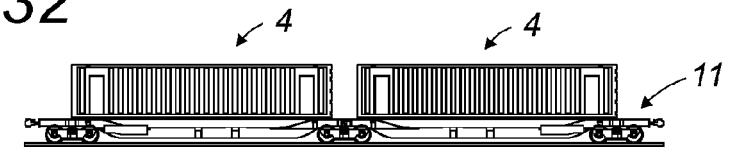
Figure 33:
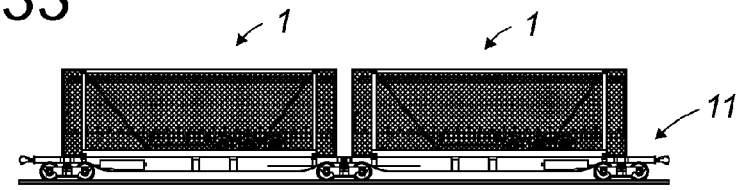
FIG. 33 is a profile view of a succession of standard transport wagons on which semi-trailers are loaded by means of a loading and unloading structure of the invention in which the support plate is flat.
Figure 34:
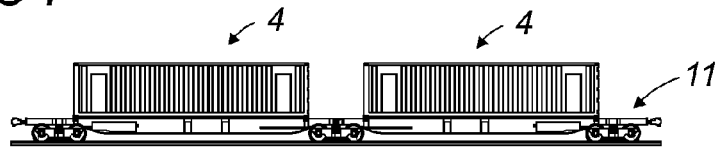
FIGS. 34 and 35 are profile views of a succession of standard transport wagons on which the transport containers are loaded.
Figure 35:
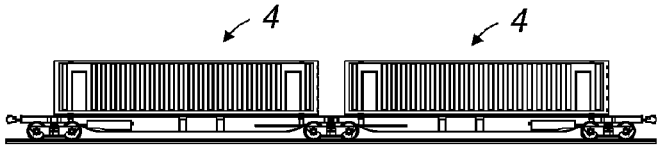
Figure 38:
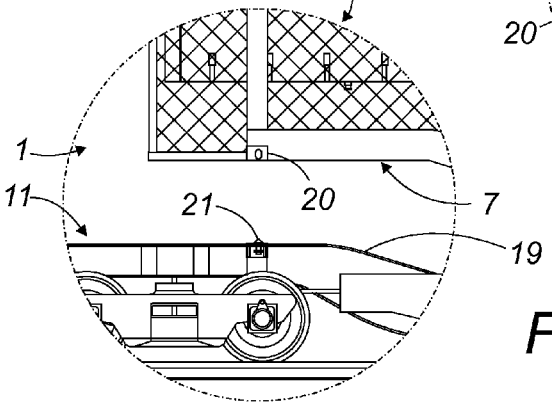

Following this first stage, the loading and unloading structure 5 comprising the semi-trailer 2 is picked up by a handling means 3 for containers 4 through the standard container interface 9 located in the upper part of the handling frame 8 (FIGS. 24, 27). The assembly consisting of the handling frame 8, the semi-trailer 2 and the support plate 7 is then lifted and moved above the support plate 7 of a regular transport wagon 11 (FIGS. 26, 29, 38).

Figure 39:
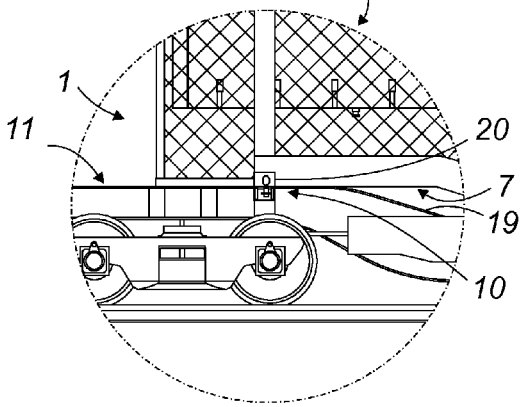

Following this second step, when the loading and unloading structure 5 including the semi-trailer 2 has been put down by the handling means 3 for containers 4 on the support plate 7 of the railway transport wagon 11, the rotating lock attaching devices of the railway transport wagon 11 are locked with those of the loading and unloading structure 5, located at the bottom of the support plate 7 (see FIG. 39) and the handling means 3 for containers can be moved away. The assembly formed by the handling frame 8, the semitrailer 2 and the flat support 7 is then ready for transport by rail.

For both variants, only those referring to the loading steps of a semi-trailer 2 onto a world transport wagon 11 using the loading and unloading structure 1 of the invention have been described. Unloading is carried out by the same operations in the opposite order, obvious to the professional.

For both these variants, the loading/unloading operations are advantageously fast and simple to accomplish and both steps can be performed in parallel by a different operator (i.e., the heavy goods vehicle driver and the container carrier operator), for an even greater gain in time.

The front end 14 and/or rear end 15 of handling frame 8 can be open, closed or suitable for closing in order to prohibit or enable access to the rear doors 16 of a semi-trailer 2 enclosed by the handling frame 8 of the invention.

The handling frame 8 appears preferentially in the form of a rigid structure whose sizes are sufficient to enclose completely a semi-trailer 2.

In its upper part, the handling frame has the same attaching devices 10 as a standard conventional container 4, i.e., corner gussets 20 designed to accommodate the rotating locks 21. Preferentially, these attaching devices 10 are placed on the upper surface of the handling frame 8 but can also be placed on the sides.

The sides 17, 18 of the handling frame 8 can be open, closed or even reinforced to protect or not protect the sides of the semi-trailer, in particular from aggressions. In the figures, the sides 17, 18 are shown as a grill. They can also be presented as a solid or hollow frame, a wall, or any other form to suit the requirement as long as the handling frame 8 has sufficient mechanical strength to allow the lifting of the weight of a support plate 7 and a semi-trailer 8 carried with it.

The support plate 7 is preferentially in the form of a rigid structure comprising a loading and unloading plane designed to receive and support the weight of a semi-trailer. In the lower part, preferably on the underside, this support plate 7 can have attaching devices 10 identical to those on the standard containers 4 used for locking them. In particular when the gauge of the semi-trailer 2 will not allow it, the support plate 7 can include attaching devices 10 located not on the underside, but on the sides.

A base plate as usually provided on a semi-trailer transport railway wagon 2 can also be used for locking the semi-trailer 2 onto the chassis of the railway transport wagon 11.

The support plate 7 can be flat or dished to be carried in the second case by a railway wagon 11 with an extra-low chassis, designed to lower the loading and unloading plane and address the standards relative to the height of railway transport, for instance for a tall gauge semi-trailer 2.

According to the variant shown in the various figures, support plate 7 does not swivel with respect into the railway wagon 11 on which it is loaded. In this case, support plate 7 is placed on the ground 12 for the loading or unloading of the semitrailer 2 on it, before or after being loaded onto a railway wagon 11, as shown in the figures.

According to the variant of the invention not shown in the figures, support plate 7 can swivel with respect into the railway wagon 11 on which it is loaded. In this case, the existing means of handling 3 containers 4 can cause this support plate 7 to swivel and the semi-trailer 2 can be loaded or unloaded directly or from the support plate 7 while the latter is carried on the railway transport wagon 11. The pivoting of the support plate 7 can be accomplished by the swiveling head function generally available in the existing handling means 3 of containers 4. It is obvious that the invention is not confined to the preferential embodiment modes described previously and shown in the various figures whereby the professional can make many modifications to it, and imagine other alternatives, without moving at out of the scope of framework of the invention.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. An apparatus for loading and unloading a semi-trailer on a rail transport wagon comprising:

a loading and unloading structure designed to accommodate a semi-trailer and sized to receive an entirety of the semi-trailer, the loading and unloading structure detached from and attachable to the semi-trailer, the loading and unloading structure detached from and attachable to the rail transport wagon, the loading and unloading structure including:

a lower part in the form of a support plate that extends across the bottom of the loading and unloading structure, the support plate having a planar portion which is designed to carry the semi-trailer, designed to support wheels and legs of the semi-trailer, and designed to be driven on by the semi-trailer;

an upper part in the form of a handling frame designed for handling and moving by a standard container handling system;

an attaching device to selectively lock the loading and unloading structure to the rail transport wagon; and a locking device to selectively immobilize the semi-trailer with respect to the support plate wherein the support plate and the handling frame are connected by a separable connection.

2. The apparatus of claim 1 wherein a top of the handling frame has a standard container interface designed to be handled and moved by the standard handling system for containers.

3. The apparatus of claim 2 wherein the standard container interface is situated on an upper face of the handling frame.

4. The apparatus of claim 1 wherein a top and a bottom of the handling frame each have a standard container interface with attaching devices.

5. The apparatus of the claim 1 wherein the support plate has attaching devices at the bottom.

6. The apparatus of claim 5 wherein the attaching devices are situated on a lower face of the handling frame.

7. The apparatus of claim 4 wherein the attaching devices are situated on sides of the support plate.

8. The apparatus of claim 4 wherein the attaching devices are corner gussets designed to accommodate rotating locks, identical to those of standard containers.

9. The apparatus of claim 1 wherein the handling frame is in the form of a rigid structure designed to enclose entirely the semi-trailer.

10. The apparatus of claim 1 wherein a side, a front, or a rear end of the handling frame is open.

11. The apparatus of claim 1 wherein two sides, a front, and a rear end of the handling frame are closed.

12. The apparatus of claim 1 wherein side sections of the handling frame are open.

13. The apparatus of claim 1 wherein side sections of the handling frame are closed.

14. The apparatus of claim 13 wherein the side sections of the handling frame are in the form of a grill.

15. The apparatus of claim 1 wherein the support plate is in the form of a rigid structure comprising a loading and unloading plane designed to receive and support the weight of a semi-trailer.

16. The apparatus of claim 1 wherein the support plate is flat.

17. The apparatus of claim 1 wherein the support plate is in the form of a gondola.

18. The apparatus of claim 1 wherein the semi-trailer has a tie-down point, the semi-trailer is locked at the tie-down point, and the semi-trailer is immobilized on the support plate or on the handling frame by being locked at the tie-down point.

19. The apparatus of claim 1 wherein the locking device is coupled to the support plate.

20. The apparatus of claim 1 wherein the locking device is coupled to the rail transport wagon.

* * * * *